US010140965B2

(12) United States Patent
Yamamoto

(10) Patent No.: US 10,140,965 B2
(45) Date of Patent: Nov. 27, 2018

(54) AUTOMATED MUSICAL PERFORMANCE SYSTEM AND METHOD

(71) Applicant: Yamaha Corporation, Hamamatsu, Shizuoka (JP)

(72) Inventor: Kazuhiko Yamamoto, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 15/728,803

(22) Filed: Oct. 10, 2017

(65) Prior Publication Data

US 2018/0102119 A1 Apr. 12, 2018

(30) Foreign Application Priority Data

Oct. 12, 2016 (JP) ..... 2016-200584

(51) Int. Cl.

| | |
|---|---|
| ***A63H 5/00*** | (2006.01) |
| ***G04B 13/00*** | (2006.01) |
| ***G10H 1/00*** | (2006.01) |
| ***G10H 1/36*** | (2006.01) |

(52) U.S. Cl.

CPC ..... *G10H 1/0008* (2013.01); *G10H 1/0033* (2013.01); *G10H 1/361* (2013.01); *G10H 1/368* (2013.01)

(58) Field of Classification Search

CPC .... G10H 1/0008; G10H 1/0033; G10H 1/361; G10H 1/368

USPC ..... 84/609

See application file for complete search history.

(56) References Cited

U.S. PATENT DOCUMENTS

| | | | | |
|---|---|---|---|---|
| 5,005,459 | A * | 4/1991 | Adachi | G10H 1/368 84/453 |
| 5,890,116 | A * | 3/1999 | Itoh | G10H 1/0008 704/260 |
| 6,087,577 | A * | 7/2000 | Yahata | G09B 15/003 84/470 R |
| 6,166,314 | A * | 12/2000 | Weinstock | G10G 3/04 84/477 R |
| 6,245,982 | B1 * | 6/2001 | Suzuki | G09B 15/002 84/477 R |
| 6,646,644 | B1 * | 11/2003 | Suzuki | G10H 1/0008 345/473 |
| 6,717,042 | B2 * | 4/2004 | Loo | G10H 1/0008 345/473 |
| 6,800,799 | B2 | 10/2004 | Fujiwara et al. | |
| 8,088,985 | B1 * | 1/2012 | Bowser | A63J 17/00 84/477 R |

(Continued)

FOREIGN PATENT DOCUMENTS

JP 2003271138 A 9/2003

*Primary Examiner* — Jeffrey Donels

(74) *Attorney, Agent, or Firm* — Global IP Counselors, LLP

(57) ABSTRACT

A performance system to allow a performer of an actual performance to more appropriately ascertain the progress of an automatic performance by a performance device. The performance system comprises a performance controller that causes a performance device to carry out an automatic performance of a musical piece, and a notification controller that causes a notification device to carry out an operation to visually notify a performer of an actual performance of a musical piece of the progress of the automatic performance.

20 Claims, 4 Drawing Sheets

(56) References Cited

U.S. PATENT DOCUMENTS

| | | | | |
|---|---|---|---|---|
| 8,847,053 | B2 * | 9/2014 | Humphrey | G09B 5/065 434/308 |
| 9,711,118 | B2 * | 7/2017 | Gimate-Welsh | G10H 1/0008 |
| 9,734,812 | B2 * | 8/2017 | Katto | G10H 7/00 |
| 2003/0110926 | A1 * | 6/2003 | Sitrick | G09B 15/023 84/477 R |
| 2008/0260184 | A1 * | 10/2008 | Bailey | G10H 1/368 381/119 |
| 2013/0305903 | A1 * | 11/2013 | Fong | G10H 1/26 84/609 |
| 2015/0287291 | A1 * | 10/2015 | Regnier | G10H 1/0016 455/502 |

* cited by examiner

AUTOMATED MUSICAL PERFORMANCE SYSTEM AND METHOD

CROSS-REFERENCE TO RELATED APPLICATION

This application claims the benefit of Japanese Patent Application No. 2016-200584, filed on Oct. 12, 2016, the entire contents of Japanese Patent Application No. 2016-200584 being incorporated herein by reference.

BACKGROUND

Field of the Invention

The present invention relates to an automatic performance technique.

Description of the Related Art

Various automatic performance techniques for causing instruments, such as keyboard instruments, to emit sounds, using music data, which represent the performance contents of musical pieces, have been conventionally proposed. For example, Japanese Laid-Open Patent Publication No. 2003-271138 discloses a configuration to carry out automatic performance using music data in synchronization with a reproduction of audio data by an audio data reproduction device.

SUMMARY

When an actual performer plays an instrument (hereinafter referred to as "actual performance") in parallel with an automatic performance, it is necessary for the performer of the actual performance to carry out the actual performance synchronously with the automatic performance. However, it is necessary for the performer of the actual performance to ascertain the progress of the automatic performance by listening to the performance sound of the automatic performance, so that there is a problem that the performer cannot appropriately ascertain the progress of the automatic performance. In view of the circumstance described above, an object of the present invention is to allow a performer of an actual performance to ascertain more appropriately the progress of an automatic performance by a performance device.

In order to achieve the object described above, the performance system according to a preferred aspect of the present invention comprises a performance controller that causes a performance device to carry out an automatic performance of a musical piece, and a notification controller that causes a notification device to carry out an operation to visually notify the performer of the actual performance of the musical piece of the progress of the automatic performance. In an automatic performance method according to a preferred aspect of the present invention, a computer causes a performance device to carry out an automatic performance of a musical piece and causes a notification device to carry out an operation to visually notify the performer of the actual performance of the musical piece of the progress of the automatic performance.

BRIEF DESCRIPTION OF THE DRAWINGS

Referring now to the attached drawings which form a part of this original disclosure.

Figure 1:
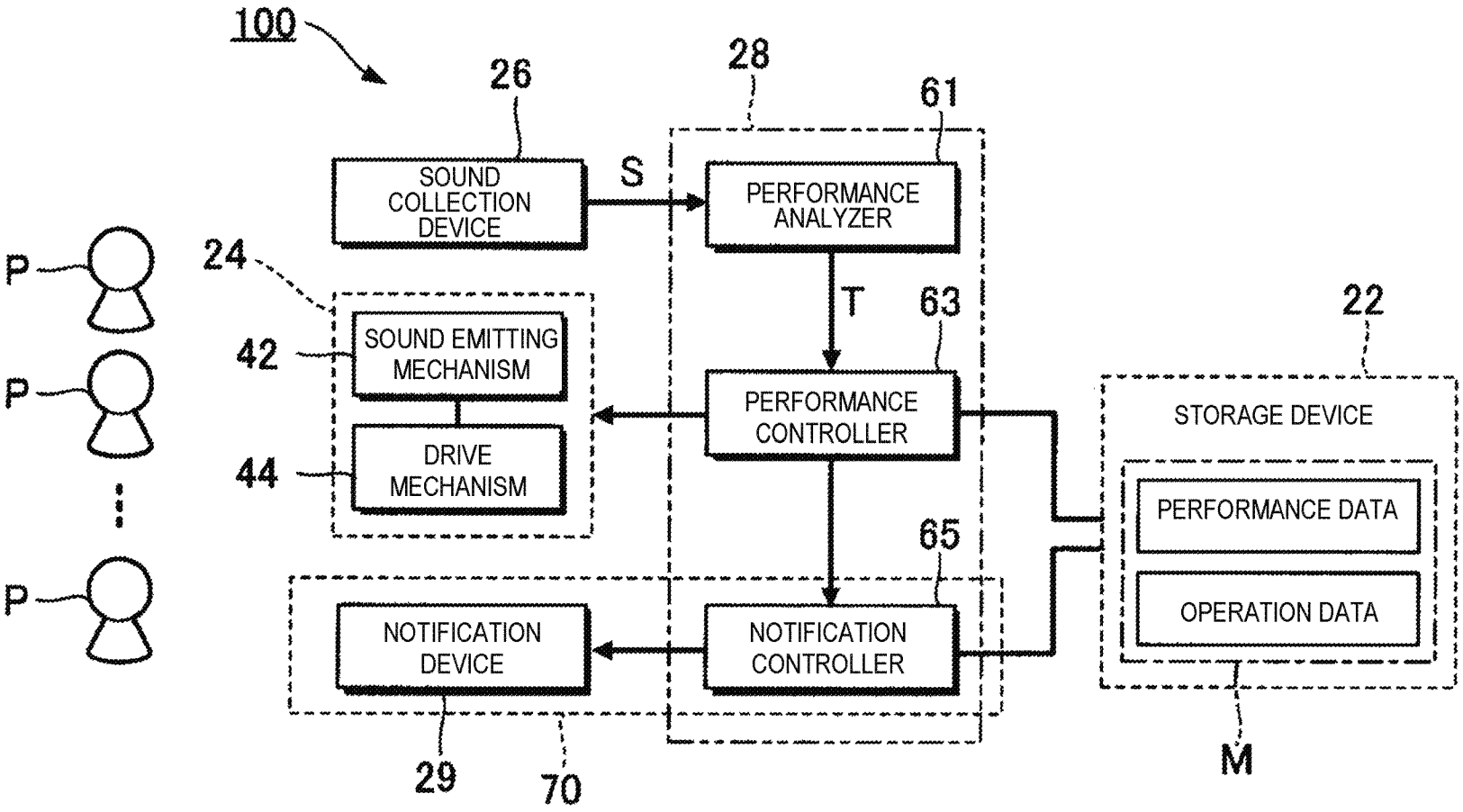
FIG. 1 is a block diagram of a performance system according to an embodiment of the present invention.

It should be noted that these figures are intended to illustrate the general characteristics of methods and structure utilized in the illustrative embodiment and to supplement the written description provided below. These drawings may not precisely reflect the precise structural or performance characteristics of any given embodiment, and should not be interpreted as defining or limiting the range of values or properties encompassed by illustrative embodiments unless specified.

DETAILED DESCRIPTION OF EMBODIMENTS

Selected embodiments will now be explained with reference to the drawings. It will be apparent to those skilled in the music field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

FIG. 1 is a block diagram of a performance system 100 according to a preferred embodiment of the present invention. The performance system 100 is installed in a space, such as a music hall, in which a plurality of performers P play musical instruments. Specifically, the performance system 100 is a computer system that executes, in parallel with the performance of a musical piece by a plurality of performers P (hereinafter referred to as "target musical piece"), an automatic performance of the target musical piece and that visually notifies the performers P of the progress of the automatic performance.

The performance system 100 according to the present embodiment notifies the performers P of the progress of an automatic performance by displaying an image (hereinafter referred to as "notification image") G that visually represents the progress of the automatic performance that can be viewed by the performers P in the space (for example, the floor of the stage on which the performers P stand). While the performers P are typically performers P of musical instruments, singers of a target musical piece can also be the performers P. That is, the "performance" in the present application includes not only performances of musical instruments, but also singing. In addition, persons who are not in charge of actually playing a musical instrument (for example, a concert conductor, or a sound engineer during a recording session) may also be included as the performers P.

As illustrated in FIG. 1, the performance system 100 comprises a storage device 22, a performance device 24, a sound collection device 26, a control device 28, and a notification device 29. The storage device 22 and the control device 28 are realized by an information processing device, such as a personal computer.

The storage device 22 is configured from a well-known storage medium, such as a magnetic storage medium or a semiconductor storage medium, or from a combination of a plurality of types of storage media, and stores a program that is executed by the control device 28, and various data that are used by the control device 28. Moreover, a storage device 22 that is separate from the performance system 100

(for example, cloud storage) may be prepared, and the control device 28 may execute reading from and writing to the storage device 22 via a communication network, such as a mobile communication network or the Internet. That is, the storage device 22 may be omitted from the performance system 100.

The storage device 22 of the present embodiment stores a music file M. As illustrated in FIG. 1, the music file M includes performance data and operation data. For example, a file in a format conforming to the MIDI (Musical Instrument Digital Interface) standard (SMF: Standard MIDI File) is suitable as the music file M. The performance data and the operation data are data that occupy distinct channels inside the same music file M.

Figure 2:
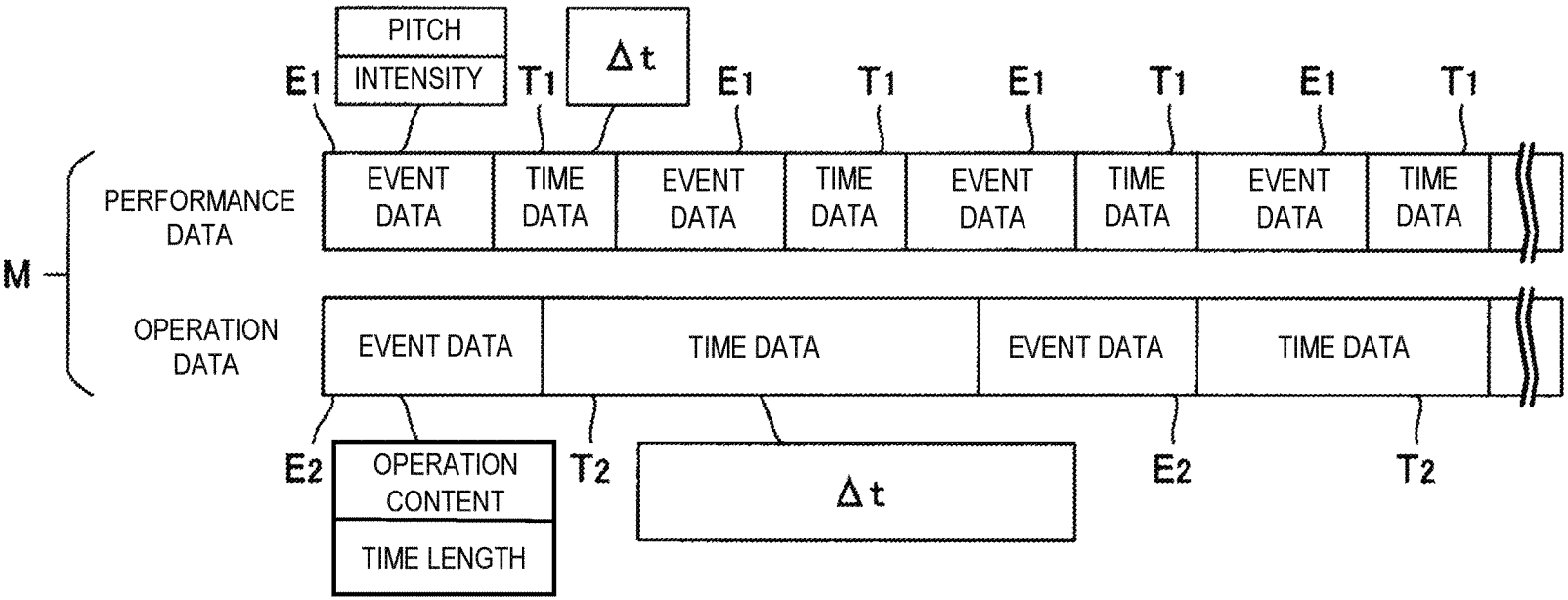
FIG. 2 is an explanatory view of performance data and operation data.

FIG. 2 is explanatory view of the performance data and the operation data. The performance data specifies the performance content of the target musical piece by the performance device 24. Specifically, as illustrated in FIG. 2, the performance data are time-series data in which are arranged event data E1 indicating the performance content and time data T1 indicating the generation time points of the event data E1. The performance data assign pitch (note number) and intensity (velocity), and instruct various events such as pronunciation and mute. Time data T1 specify, for example, the interval Δt (delta time) of successive event data E1. The content and usage of the operation data will be described below. As described above, since performance data and operation data are included in one music file M as distinct channels, the handling of the performance data and the operation data becomes easier compared with a configuration in which each of the performance data and the operation data are included in separate music files. Specifically, there is the advantage that performance data and operation data can be created in a common format.

The performance device 24 of FIG. 1 executes an automatic performance of a target musical piece under the control of the control device 28. Specifically, among the plurality of performance parts that constitute a target musical piece, a performance part that is different from the performance parts of the plurality of performers P (for example, string instruments) is played by the performance device 24. The performance device 24 of the present embodiment is an electronic instrument that is capable of an automatic performance of a target musical piece, and is a keyboard instrument that comprises a sound emitting mechanism 42 and a drive mechanism 44. The sound emitting mechanism 42 is a string striking mechanism that causes a string (that is, a sound emitting body) to emit sounds in conjunction with the depression of each key on a keyboard. Specifically, the sound emitting mechanism 42 comprises, for each key, a hammer that is capable of striking a string, and an action mechanism configured from a plurality of transmitting members (for example, wippens, jacks, and repetition levers) that transmit the depression of the key to the hammer. The drive mechanism 44 executes a performance of the target musical piece (that is, automatic performance) by driving the sound emitting mechanism 42. Specifically, the drive mechanism 44 is configured comprising a plurality of driving bodies (for example, actuators, such as solenoids) that depress each key, and a drive circuit that drives each driving body. An automatic performance of the target musical piece is realized by the drive mechanism 44 driving the sound emitting mechanism 42 in accordance with instructions from the control device 28. Moreover, it is also possible to mount the control device 28 or the storage device 22 in the performance device 24.

The sound collection device 26 collects sounds emitted by a performance of musical instruments by a plurality of performers P (for example, musical sounds or vocal sounds) and generates a sound signal S. For example, a microphone is a preferable example of the sound collection device 26. The acoustic signal S is a signal that represents the waveform of a sound. Moreover, it is also possible to use an acoustic signal S that is output from an electronic musical instrument, such as an electronic string instrument. Therefore, the sound collection device 26 may be omitted. The notification device 29 displays various images under the control of the control device 28 (notification controller 65—also referred to as a "notification controller"). For example, a display (e.g., a LED display, LCD display, etc.) or a projector are two preferable examples of the notification device 29.

The control device 28 is a processing circuit such as a CPU (central processing unit) that comprehensively controls each element of the performance system 100. The control device 28 realizes a plurality of functions for causing the performance device 24 to carry out an automatic performance (performance analyzer 61, performance controller 63—also referred to as a "performance controller"), and a function for notifying the progress of the automatic performance (notification controller 65), by executing a program that is stored in the storage device 22. Moreover, a configuration in which the function of the control device 28 is realized by a group of a plurality of devices (that is, a system) or a configuration in which all or part of the functions of the control device 28 are realized by a dedicated electronic circuit may also be employed. Additionally, it is also possible for a server device, which is located away from the space in which the performance device 24, the sound collection device 26, and the notification device 29 are installed, such as a music hall, to realize all or part of the functions of the control device 28.

The performance analyzer 61 in FIG. 1 subsequently estimates the point in time of the target musical piece in which the plurality of performers P are currently playing (hereinafter referred to as "performance position") T, in parallel with the performance by each performer P. Specifically, the performance analyzer 61 estimates the performance position T by analyzing the acoustic signal S that is generated by the sound collection device 26. The estimation of the performance position T is repeated at a predetermined cycle. A well-known acoustic analysis technique (score alignment) can be freely employed for the estimation of the performance position T.

The performance controller 63 causes the performance device 24 to carry out an automatic performance of the target musical piece. The performance controller 63 of the present embodiment causes the performance device 24 to carry out an automatic performance in parallel with the actual performance so as to be synchronized with the progress of the actual performance of the target musical piece. Performance data of the music file M are used for executing the automatic performance. Specifically, the performance controller 63 instructs the performance device 24 to start the automatic performance and instructs the performance device 24 of the performance content specified by the performance data of the point in time that corresponds to the performance position T estimated by the performance analyzer 61. That is, the performance controller 63 is a sequencer that sequentially supplies each event data E1 included in the performance data of the target musical piece to the performance device 24. The performance device 24 carries out an automatic performance of the target musical piece in accordance with an instruction from the performance controller 63. Since the performance position T moves to the rear of the target musical piece along with the progression of the performance by the plurality of performers P, the automatic performance of the target musical piece by the performance device 24 will also progress with the movement of the performance position T. As can be understood from the explanation above, the performance controller 63 instructs the performance device 24 to carry out the automatic performance so that the tempo of the performance and the timing of each sound will be synchronized with the performance by the plurality of performers P (that is, so as to be changed from the content specified in the performance data), while matching the intensity of each sound and the musical expressions, such as phrase expressions, of the target musical piece to the content specified by the performance data.

The notification controller 65 causes the notification device 29 to carry out an operation to visually notify the performers P of the progress of the automatic performance. The notification controller 65 of the present embodiment causes the notification device 29 to display a notification image G and controls the notification device 29 such that the notification image G will change with the progress of the automatic performance. Specifically, the notification controller 65 outputs image data, which represent a notification image G that changes with the progress of the automatic performance, to the notification device 29 in accordance with the control of the performance device 24 by the performance controller 63 (or, in accordance with the performance position T that is estimated by the performance analyzer 61). The notification device 29 notifies the performers P of the progress of the automatic performance by displaying the notification image G represented by the image data output by the notification controller 65.

Figure 3:
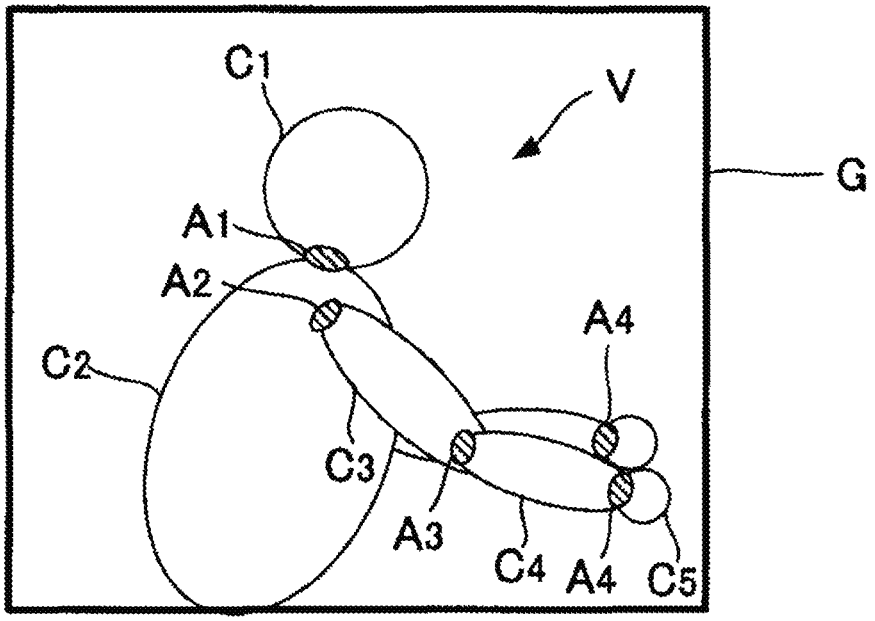
FIG. 3 is an explanatory view of a notification image.

FIG. 3 is a display example of the notification image G. As illustrated in FIG. 3, the notification image G is an image that, for example, simulates a figure of virtual performer (hereinafter referred to as "virtual performer") V playing an instrument in a virtual space. The notification image G of the present embodiment is a dynamic image that changes dynamically and is an image comprising a plurality of elements (hereinafter referred to as "movable elements") C that are connected by respective joint portions A. Each movable element C is a part of the body of the virtual performer V (for example, head C1, torso C2, upper arm C3, forearm C4, hand C5, and the like), and the joint portions A are joints that connect one body part to another body part of the virtual performer V (for example, neck joint A1, shoulder joint A2, elbow joint A3, carpal joint A4, and the like). When a joint A is driven, the joint A itself is moved and each movable element C joined by the joint A are also moved. For example, if the elbow joint A3 is driven, the elbow joint A3 itself is moved, and the upper arm C3 and the forearm C4, which are connected by the elbow joint A3 are also moved. The plurality of performers P are able to visually recognize the notification image G displayed by the notification device 29 at any time, in parallel with the performance of the target musical piece. It is preferable for type of musical instrument that is played by the virtual performer V to be the same type of musical instrument that is represented by the performance sound of the performance device 24.

The notification controller 65 of the present embodiment causes the notification device 29 to carry out normal operations and instruction operations. A normal operation is an operation that continues during the performance of the target musical piece. Specifically, a normal operation is an operation for changing the notification image G so as to simulate the state in which the virtual performer V continues a normal movement of the body when playing a musical instrument. For example, if the musical instrument that is played by the virtual performer V simulated by the notification image G is a piano, a normal operation is an operation for changing the notification image G such that the virtual performer V depresses and releases the keys of the piano according to the performance content of the automatic performance.

An instruction operation is an operation that occurs within a specific section of the target musical piece. Specifically, the instruction operation is an operation for changing the notification image G so as to simulate a state in which the virtual performer V carries out special bodily movements in specific sections of the target musical piece; for example, performance timings within specific sections, such as the start point of the target musical piece and the resume point from a long rest, are notified. For example, if the musical instrument that is played by the virtual performer V simulated by the notification image G is a piano, the instruction operation is an operation that a performer P would be able to visually distinguish from a normal operation, such as an operation for changing the notification image G such that the upper limb (upper arm C3, forearm C4, and hand C5) is to be raised high, or, an operation for changing the notification image G such that the upper limb is to be lowered from a high position. Moreover, the notification controller 65 uses the entire body to simulate a virtual performer V playing the piano more naturally, by moving each of the plurality of movable elements C in both normal operations and instruction operations. As can be understood from the foregoing description, each performer P is able to render his or her own style of playing a musical instrument merely by confirming the performance state of a performer that does not actually exist through visual recognition of the notification image G displayed by the notification device 29.

The notification controller 65 controls the normal operation according to performance data in the music file M. Specifically, the notification controller 65 starts a normal operation with the start of an automatic performance by the performance device 24 and causes the notification device 29 to carry out the normal operation by driving the joint portions A in accordance with the performance data as the automatic performance continues. The notification controller 65 of the present embodiment causes the notification device 29 to display a notification image G, in which each joint and each movable element C moves, by driving each joint portion A in accordance with the event data E1 of the performance data of FIG. 2. For example, the notification controller 65 causes the notification device 29 to display a notification image G in which a virtual performer V moves so as to strongly depress and release the keys if the intensity (velocity) specified by the event data E1 is high, by imparting a strong force to each joint portion A. On the other hand, if the intensity specified by the event data E1 is low, the notification device 29 is caused to display a notification image G in which the virtual performer V moves so as to softly depress and release the keys, by imparting a weak force to each joint portion A. On the other hand, the notification controller 65 causes the notification device 29 to display a notification image G in which the virtual performer V has stopped playing if the sound emission by the performance device 24 is stopped (that is, when an intensity is not specified by the event data E1). As can be understood from the foregoing description, during the control of the normal operation, the notification controller 65 changes the intensity of the performance data specified by the velocity as the magnitude of the force that is applied to each join portion A.

In addition, the notification controller 65 controls the instruction operation in accordance with operation data included in the music file M together with performance data. Here, the operation data are data independent of the performance data and specify the instruction operation. Since an instruction operation is specified by the operation data, which are distinct from the performance data, there is the advantage that an instruction operation can be specified independently of the normal operation.

Specifically, as illustrated in FIG. 2, the operation data are time-series data in which are arranged event data E2 indicating the instruction content, and time data T2 indicating the generation time points of the event data E2. The operation data specify the content of a special movement of the virtual performer V (hereinafter referred to as "operation content") and the length of time of the movement. For example, an operation content is specified as a MIDI note number, and the time length is specified as a MIDI velocity. Time data T2 specify, for example, the interval Δt (delta time) of successive event data E2.

Specifically, the notification controller 65 causes the notification device 29 to carry out an instruction operation by driving the joint portions A in accordance with the operation data. The notification controller 65 causes the notification device 29 to display a notification image G, in which each joint portion A and each movable element C moves, by driving each joint portion A in accordance with the operation content and the time length specified by the operation data in FIG. 2. For example, if "raise" is specified as the operation content and "1 second" is specified as the time length in the operation data, the notification controller 65 applies, to each joint portion A, a force that is set in advance regarding the operation content of "raising" and drives each joint portion A for "1 second" to cause the notification device 29 thereby to display a notification image G in which the upper limb is raised to a high position over a period of one second. For example, the time length of the operation data is specified so that the instruction operation will be completed at the start point of the target musical piece and the resume point from a long rest. As can be understood from the description above, the notification device 29 and the notification controller 65 function as a notification unit 70 that visually notifies the performer P of the progress of the automatic performance.

The instruction operation can be carried out in parallel with the normal operation. That is a force that corresponds to the operation content specified by the operation data is added to the force that is applied to each joint portion A in accordance with the performance data. Here, for example, a configuration that uses data that specify the position of each joint portion A according to the instruction operation and the position of each joint portion A according to the normal operation (hereinafter referred to as "comparative example") can be assumed to be a configuration for realizing an instruction operation and a normal operation. However, in the comparative example, there is the possibility of the position of each joint portion A moving discontinuously, at the point in time in which the instruction operation is started during a continuation of the normal operation, as well as at the point in time in which the instruction operation ends. In the embodiment, since a state in which a force corresponding to the performance data and the operation data acts on each joint portion A is simulated, the position of each joint portion A and each movable element C changes continuously, even if an instruction operation is generated during the continuation of a normal operation. Therefore, it is possible to display a notification image G in which the virtual performer V moves more naturally. However, the configuration of the comparative example can also be included within the scope of the present invention.

Figure 4:
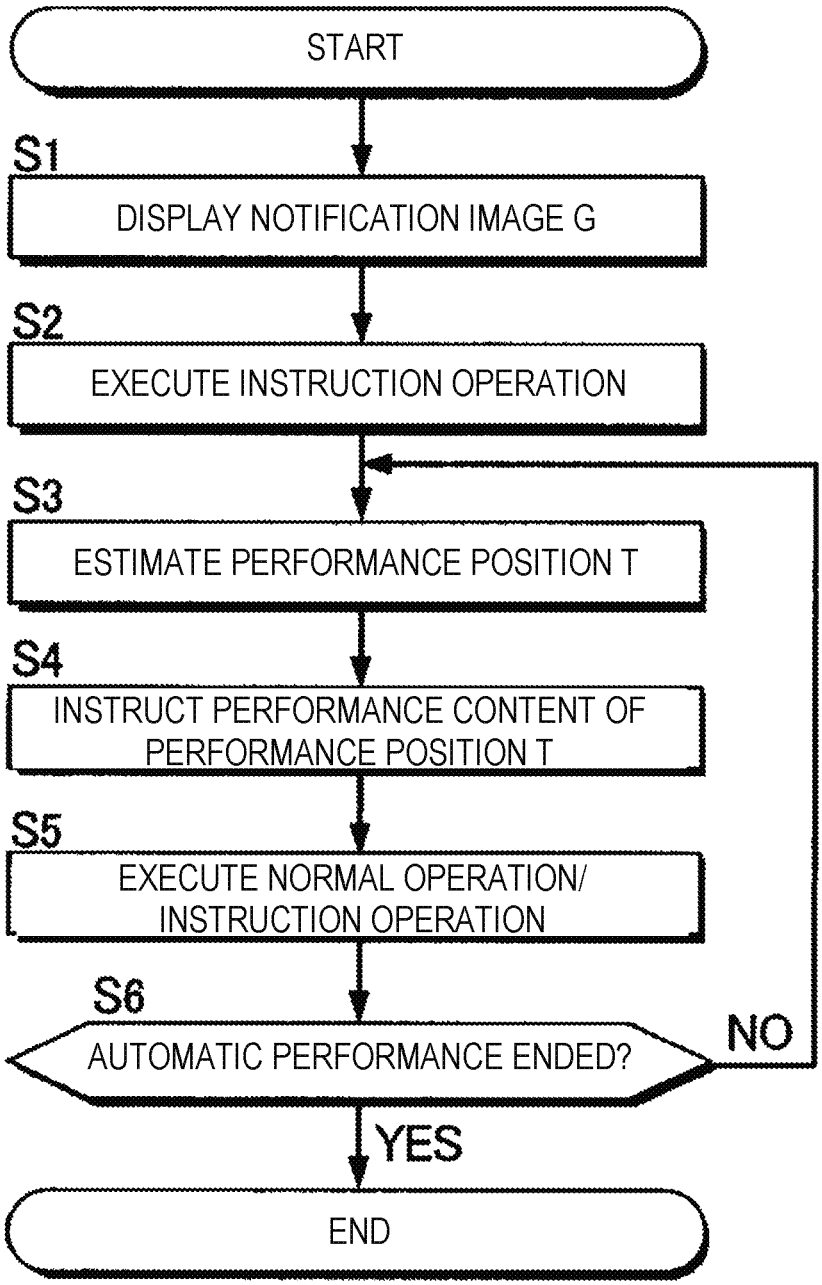
FIG. 4 is a flowchart of an operation of the control device.

FIG. 4 is a flowchart of an operation of the control device 28. For example, the processing of FIG. 4 is started, triggered by an instruction for activation being given to the performance device 24 by a user. When the processing of FIG. 4 is started, the notification controller 65 causes the notification device 29 to display a notification image G in which is simulated a virtual performer V immediately before starting the performance of the piano (for example, a state in which the player's hands are placed on the keyboard and are stationary) (S1). The notification controller 65 causes the notification device 29 to carry out an instruction operation for notification of the start of the target musical piece (S2). The plurality of performers P ascertain the timing to start the performance of the target musical piece by visually confirming a notification image G that changes in accordance with the instruction operation that is carried out by the notification device 29 (the virtual performer V makes a movement to raise the upper limb high), and start the actual performance.

The performance analyzer 61 estimates the performance position T by an analysis of the acoustic signal S that is supplied from the sound collection device 26 (S3). The performance controller 63 instructs the performance device 24 of the performance content corresponding to the performance position T estimated by the performance analyzer 61 (S4). The notification controller 65 causes the notification device 29 to carry out the normal operation and the instruction operation (S5). Specifically, the notification controller 65 controls the notification device 29 such that the notification image G changes by driving each of the plurality of joint portions A of the virtual performer V according to the performance data or the operation data. If the automatic performance does not end (S6; NO), that is, if the performance of the target musical piece continues Steps S3 to Step S5 are repeated. If the automatic performance ends (S6; YES), for example, if the entire performance of the target musical piece has ended, or, if the user issues a command to end the automatic performance, the steps of FIG. 4 are ended.

In the embodiment illustrated above, the progress of the automatic performance of the performance device 24 is visually notified to the performer P of the actual performance. Therefore, compared with a configuration in which the progress of the automatic performance of the performance device 24 is not visually notified, for example, a configuration in which the performer of the actual performance ascertains the progress of the automatic performance of the performance device 24 by listening to the performance sound of the performance device 24, the performer P of the actual performance is able to confirm, not only audibly but also visually, the progress of the automatic performance of the performance device 24. As a result, it is possible for the performer P of the actual performance to ascertain more appropriately the progress of the automatic performance by the performance device 24.

Additionally, in the present embodiment, the automatic performance is carried out in parallel with the actual performance so as to be synchronized with the progress of the actual performance, while a notification image G is displayed on the notification device 29; therefore, it is possible for the performer P to visually confirm the progress of the automatic performance that is synchronized with the progress of the actual performance and reflect the observation onto the performer's own performance. Therefore, a natural ensemble is realized, in which the performance of a plurality of performers P and the automatic performance by the performance device 24 interact with each other.

Modifications

The embodiment illustrated above can be variously modified. Specific modified embodiments are illustrated below. Two or more embodiments freely selected from the following examples can be appropriately combined to the extent that such embodiments do not contradict each other.

(1) In the above-described embodiment, an example of an automatic performance was shown, in which the target musical piece is performed by mechanically operating a sound emitting mechanism 42, which is similar to a natural musical instrument, with a drive mechanism 44; however, the present invention can be applied to an automatic performance in which a target musical piece is performed by electrically driving a sound source device that generates an acoustic signal S that represents an instructed sound (for example, a karaoke performance).

(2) In the above-described embodiment, the notification controller 65 causes the notification device 29 to display a notification image G that changes with the progress of the automatic performance, and thereby carry out an operation to report the progress of the automatic performance; however, the method to cause the notification device 29 to carry out an operation to report the progress of the automatic performance is not limited to the example described above. For example, a robot that is capable of simulating the appearance and motion of a human being, which is configured from a plurality of joint portions and a plurality of movable elements, may be set as the notification device 29, and the notification controller 65 may carry out an operation to report the progress of the automatic performance by mechanically operating each joint portion A of the notification device 29 along with the progress of the automatic performance. As can be understood from the foregoing description, the notification controller 65 represents, overall, an element that causes the notification device 29 to carry out an operation to visually notify the performer P of the progress of the automatic performance. However, according to the above-described embodiment, in which the notification device 29 is caused to display a notification image G that changes with the progress of the automatic performance, the performer P is able to ascertain the progress of the automatic performance from the notification image G.

(3) In the above-described embodiment, the notification controller 65 causes the notification device 29 to carry out a normal operation and an instruction operation; however, the operation content is arbitrary, as long as the operation is an operation to visually notify the performer P of the progress of the automatic performance. For example, it is also possible to cause the performance device 24 to carry out only a normal operation. However, according to the above-described embodiment in which the notification device 29 is caused to carry out a normal operation and an instruction operation, it is possible to notify the performer P of the actual performance of the performance timings in specific sections, such as the start point of the musical piece and the resume point from a long rest, by the instruction operation, compared with a configuration in which the performance device 24 is caused to carry out only a normal operation.

(4) In the above-described embodiment, the notification image G is an image that includes a plurality of elements connected by the joint portions A, but the mode of the notification image G is arbitrary. For example, it is also possible to use abstract graphical symbols, such as circles and squares, or a combination thereof, as the notification image G. However, in the above-described embodiment, in which an image comprising a plurality of elements connected by joint portions A is used as the notification image G, it is possible to intuitively or visually ascertain the progress of the automatic performance from a notification image G in which each element moves via the joint portions A (for example, an image that simulates an animate being, such as a human).

(5) In the above-described embodiment, the notification controller 65 controls a normal operation according to performance data; however, it is also possible to control the normal operation according to data that are separate from the performance data. However, according to the above-described embodiment, in which the normal operation is controlled according to the performance data, since the performance data for instructing the automatic performance are diverted to the control of the normal operation, compared with a configuration in which the normal operation is controlled by data separate from the performance data, there is the advantage that the data used by the performance system 100 are simplified.

(6) In the above-described embodiment, the performance controller 63 causes the performance device 24 to carry out an automatic performance of the target musical piece in parallel with the actual performance so as to be synchronized with the progress of the actual performance, by instructing the performance device 24 of the performance content that is specified by the performance data, regarding the time point that corresponds to the performance position T; however, the method to synchronize the automatic performance with the progress of the actual performance is not limited to the example described above. Here, time on the order of several hundred milliseconds is required for the performance device 24 to actually emit a sound (for example, for the hammer of the sound emitting mechanism 42 to strike a string), after the performance controller 63 instructs the performance device 24 to carry out an automatic performance by an output of performance data. That is, the actual emission of sound by the performance device 24 is inevitably delayed with respect to an instruction from the performance controller 63. Therefore, it is also possible for the performance controller 63 to instruct the performance device 24 to carry out a performance of a point in time that is later (i.e., in the future) in the target musical piece, relative to the performance position T that is estimated by the performance analyzer 61.

(7) In the above-described embodiment, the performance controller 63 causes the performance device 24 to carry out an automatic performance of the target musical piece in parallel with the actual performance so as to be synchronized with the progress of the actual performance of the target musical piece; however, a process to cause the automatic performance to be carried out to be in synchronization with the progress of the actual performance is not necessary.

(8) As illustrated in the above-described embodiment, the performance system 100 is realized through cooperation between the control device 28 and the program. The program according to a preferred aspect of the present invention causes a computer to function as a performance controller 63 that causes the performance device 24 to carry out an automatic performance of the target musical piece in parallel with the actual performance so as to be synchronized with the progress of the actual performance of the target musical piece, as well as a notification controller 65 that causes the notification device 29 to carry out an operation to visually notify the performer P of the actual performance of the progress of the automatic performance. The program illustrated above can be installed in the computer, provided that the program is stored in a storage medium in a form that can be read by the computer. The storage medium is, for example, a non-transitory (non-transitory) storage medium, and an optical storage medium such as a CD-ROM (optical disc) is a good example thereof, but may include well-known arbitrary storage medium formats, such as a semiconductor storage medium and a magnetic storage medium. Further, it is also possible to deliver the program to the computer in the form of distribution via a communication network.

(9) The preferred aspect of the present invention is also specified as an operation method (automatic performance method) of the performance system 100 according to the above-described embodiment. For example, in the automatic performance method according to a preferred aspect of the present invention, a computer (a system configured from a single computer or a plurality of computers) causes the performance device 24 to carry out an automatic performance of the target musical piece in parallel with the actual performance so as to be synchronized with the progress of the actual performance of the target musical piece, and causes the notification device 29 to carry out an operation to visually notify the performer P of the actual performance of the progress of the automatic performance.

(10) The configuration illustrated in each of the above-described embodiments can be expressed as follows.

Aspect 1

The performance system 100 according to a preferred aspect (aspect 1) of the present invention comprises a performance controller 63 that causes a performance device 24 to carry out an automatic performance of a musical piece, and a notification controller 65 that causes a notification device 29 to carry out an operation to visually notify a performer P of an actual performance of a musical piece of the progress of the automatic performance. In aspect 1, the performer P of the actual performance is visually notified of the progress of the automatic performance of the performance device 24. Therefore, compared with a configuration in which the progress of the automatic performance of the performance device 24 is not visually reported, for example, a configuration in which the performer P of the actual performance ascertains the progress of the automatic performance of the performance device 24 by listening to the performance sound of the performance device 24, the performer P of the actual performance is able to confirm, not only audibly but also visually, the progress of the automatic performance of the performance device 24. As a result, it is possible for the performer P of the actual performance to ascertain more appropriately the progress of the automatic performance by the performance device 24.

Aspect 2

In a preferred example (aspect 2) of aspect 1, the performance controller 63 causes the performance device 24 to carry out an automatic performance in parallel with an actual performance so as to be synchronized with the progress actual performance. In aspect 2, the progress of the automatic performance of the performance device 24, which is synchronized with the actual performance of the musical piece, is visually reported to the performer P of the actual performance. Therefore, the performer P of the actual performance is able to visually ascertain the progress of the automatic performance that is synchronized with the progress of the actual performance. In turn, a natural ensemble is realized, in which the actual performance and the automatic performance interact with each other.

Aspect 3

In a preferred example (aspect 3) of aspect 1 or aspect 2, the notification controller 65 causes the notification device 29 to carry out a normal operation, which is an operation that continues during the performance of the musical piece, and an instruction operation, which is an operation that occurs within specific sections in the musical piece. In aspect 3, the progress of the automatic performance is made known by a normal operation, which is an operation that is continued during the performance of the musical piece, and an instruction operation, which is an operation that occurs within specific sections in the musical piece. Therefore, for example, compared with a configuration in which the progress of the automatic performance of the performance device 24 is made known only by a normal operation, which is an operation that continues during the performance of a musical piece, it is possible to notify the performer P of the actual performance of the performance timings in specific sections, such as the start point of the musical piece and the resume point from a long rest, through the instruction operation, Aspect 4

In a preferred example (aspect 4) of aspect 3, the performance controller 63 causes the performance device 24 to carry out an automatic performance of the musical piece by using performance data that specify the performance content of the musical piece, and the notification controller 65 controls the normal operation according to the performance data and controls the instruction operation according to operation data, which are independent of the performance data. In aspect 4, since the performance data for instructing the automatic performance are diverted to the control of the normal operation, compared with a configuration in which the normal operation is controlled by data separate from the performance data, there is the advantage that the data used by the performance system 100 are simplified. Further, since an instruction operation is specified by the operation data, which are separate from the performance data, an instruction operation can be specified independently of the normal operation.

Aspect 5

In a preferred example (aspect 5) of aspect 4, the performance data and the operation data are included in one music file M as distinct channels. In aspect 5, the performance data and the operation data are included in one music file M as distinct channels. Therefore, the handling of the performance data and the operation data becomes easier, compared with a configuration in which each of the performance data and the operation data are respectively included in separate music files M.

Aspect 6

In a preferred example (aspect 6) of any one of aspects 1 to 5, the notification device 29 displays a notification image G, and the notification controller 65 controls the notification device 29 such that the notification image G will change with the progress of the automatic performance. In aspect 6, a notification image G that changes with the progress of the automatic performance is displayed. Therefore, the performer P of the actual performance is able to ascertain the progress of the automatic performance from the notification image G.

Aspect 7

In a preferred example (aspect 7) of aspect 6, the notification image G is an image including a plurality of elements C connected by joint portions A, and the notification controller 65 controls the notification device 29 such that the notification image G will change by driving the joint portions A with the progression of the automatic performance.

In aspect 7, a notification image G including a plurality of elements C connected by joint portions A is displayed, and the progress of the automatic performance is notified by changing the notification image G by driving each of the joint portions A together with the automatic performance. Therefore, the performer P of the actual performance is able intuitively or visually to ascertain the progress of the automatic performance from a notification image G in which each element C moves via the joint portions A (for example, an image that simulates an animate being, such as a human).

Aspect 8

In an automatic performance method according to a preferred aspect (aspect 8) of the present invention, a computer causes a performance device 24 to carry out an automatic performance of a musical piece, and causes a notification device 29 to carry out an operation to visually notify a performer P of an actual performance of a musical piece of the progress of the automatic performance. According to aspect 8, the same effect as that of the performance system 100 of aspect 1 is realized.

General Interpretation of Terms

In understanding the scope of the present invention, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A performance system comprising:

a performance controller configured to cause a performance device to carry out an automatic performance of a musical piece; and a notification controller configured to cause a notification device to carry out an operation to visually notify a performer of an actual performance of the musical piece of the progress of the automatic performance, the notification controller being configured to cause the notification device to carry out a normal operation to visually notify the performer of continuous change of a normal body movement of a virtual performer of the performance device for carrying out the automatic performance of the musical piece, the notification controller being further configured to cause the notification device to carry out an instruction operation, before notifying the performer of the continuous change of the normal body movement, to visually notify the performer of a special body movement of the virtual performer, the special body movement being visually distinguished from the normal body movement.

2. The performance system according to claim 1, wherein the performance controller is configured to cause the performance device to carry out the automatic performance in parallel with an actual performance so as to be synchronized with the progress of the actual performance.

3. The performance system according to claim 1, wherein the notification controller is configured to cause the notification device to carry out the instruction operation within specific sections in the musical piece.

4. The performance system according to claim 3, wherein the performance controller is configured to cause the performance device to carry out an automatic performance of the musical piece by using performance data that specify a performance content of the musical piece; and the notification controller is configured to control the normal operation according to the performance data and control the instruction operation according to operation data, which are independent of the performance data.

5. The performance system according to claim 4, wherein the performance data and the operation data are included in one music file as distinct channels.

6. The performance system according to claim 1, wherein the notification device displays a notification image; and the notification controller is configured to control the notification device such that the notification image will change with the progress of the automatic performance.

7. The performance system according to claim 6, wherein the notification image is an image including a plurality of elements connected by joint portions; and the notification controller is configured to control the notification device such that the notification image will change by driving the joint portions with the progress of the automatic performance.

8. The performance system according to claim 1, wherein the notification controller is configured to visually notify the performer of a start of the musical piece by causing the notification device to carry out the instruction operation.

9. The performance system according to claim 8, wherein the performance controller is configured to cause the performance device to carry out an automatic performance of the musical piece by using performance data that specify a performance content of the musical piece; and the notification controller is configured to control the normal operation according to the performance data and control the instruction operation according to operation data, which are independent of the performance data.

10. The performance system according to claim 9, wherein the performance data and the operation data are included in one music file as distinct channels.

11. The performance system according to claim 2, wherein the notification device displays a notification image; and the notification controller is configured to control the notification device such that the notification image will change with the progress of the automatic performance.

12. The performance system according to claim 11, wherein the notification image is an image including a plurality of elements connected by joint portions; and the notification controller is configured to control the notification device such that the notification image will change by driving the joint portions with the progress of the automatic performance.

13. The performance system according to claim 3, wherein the notification device displays a notification image; and the notification controller is configured to control the notification device such that the notification image will change with the progress of the automatic performance.

14. The performance system according to claim 13, wherein the notification image is an image including a plurality of elements connected by joint portions; and the notification controller is configured to control the notification device such that the notification image will change by driving the joint portions with the progress of the automatic performance.

15. The performance system according to claim 4, wherein the notification device displays a notification image; and the notification controller is configured to control the notification device such that the notification image will change with the progress of the automatic performance.

16. The performance system according to claim 15, wherein the notification image is an image including a plurality of elements connected by joint portions; and the notification controller is configured to control the notification device such that the notification image will change by driving the joint portions with the progress of the automatic performance.

17. The performance system according to claim 5, wherein the notification device displays a notification image; and the notification controller is configured to control the notification device such that the notification image will change with the progress of the automatic performance.

18. The performance system according to claim 17, wherein the notification image is an image including a plurality of elements connected by joint portions; and the notification controller is configured to control the notification device such that the notification image will change by driving the joint portions with the progress of the automatic performance.

19. The performance system according to claim 8, wherein the notification device displays a notification image; and the notification controller is configured to control the notification device such that the notification image will change with the progress of the automatic performance.

20. An automatic performance method comprising:

causing, by a computer, a performance device to carry out an automatic performance of a musical piece; and causing, by the computer, a notification device to carry out an operation to visually notify a performer of an actual performance of the musical piece of the progress of the automatic performance, the causing of the notification device to carry out the operation including causing the notification device to carry out a normal operation to visually notify the performer of continuous change of a normal body movement of a virtual performer of the performance device for carrying out the automatic performance of the musical piece, and an instruction operation, before notifying the performer of the continuous change of the normal body movement, to visually notify the performer of a special body movement of the virtual performer, the special body movement being visually distinguished from the normal body movement.

* * * * *